United States Patent [19]

Clark et al.

[11] 4,144,713

[45] Mar. 20, 1979

[54] PATIENT LIFTING DEVICE

[75] Inventors: Raymond Clark, Pewaukee; William T. Neill, Jr., Brookfield, both of Wis.

[73] Assignee: Applied Power Inc., Milwaukee, Wis.

[21] Appl. No.: 814,095

[22] Filed: Jul. 8, 1977

[51] Int. Cl.[2] ..... F15B 15/18

[52] U.S. Cl. ..... 60/477; 60/482; 5/81 R; 254/93 R; 254/DIG. 3

[58] Field of Search ..... 60/477, 482; 5/81 R, 5/81 B, 86; 254/93 R, 93 H, DIG. 3

[56] References Cited

U.S. PATENT DOCUMENTS

| | | | |
|---|---|---|---|
| 2,708,882 | 5/1955 | Wilson et al. | 254/93 R |
| 3,222,029 | 12/1965 | Hildemann | 5/81 R |
| 3,260,051 | 7/1966 | Horie | 60/482 X |
| 3,615,157 | 10/1971 | Trotta | 60/477 X |

*Primary Examiner*—Edgar W. Geoghegan
*Attorney, Agent, or Firm*—John J. Byrne

[57] ABSTRACT

An improvement in patient lifting devices comprising an upright member, a boom pivotably mounted on the upright member, a fluid cylinder pivotably mounted between the upright member and the boom, and a manually operated pump for the fluid cylinder. The improvement comprises means actuated by the pump handle for transferring fluid from the fluid cylinder to a fluid reservoir, thereby permitting the boom to lower under the combined weight of the boom itself and anyone being carried by the boom.

22 Claims, 6 Drawing Figures

FIG. 4
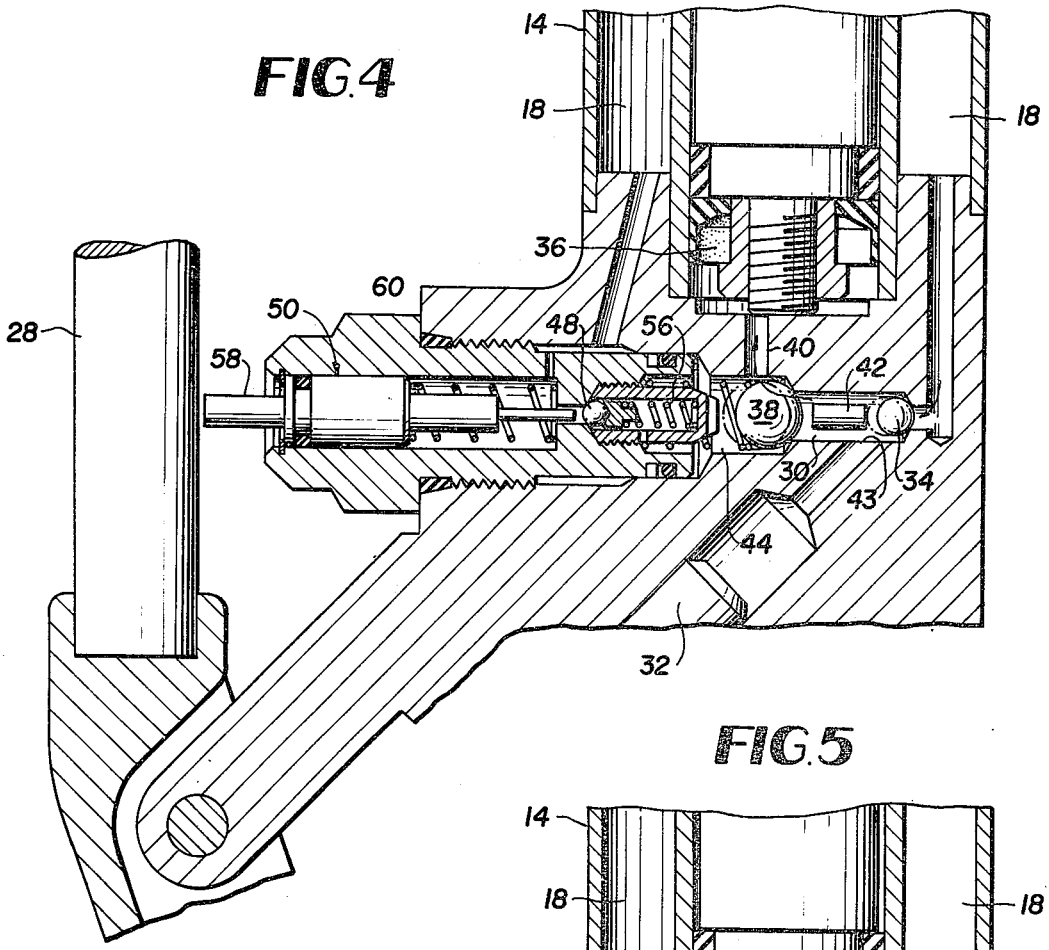
FIG. 5
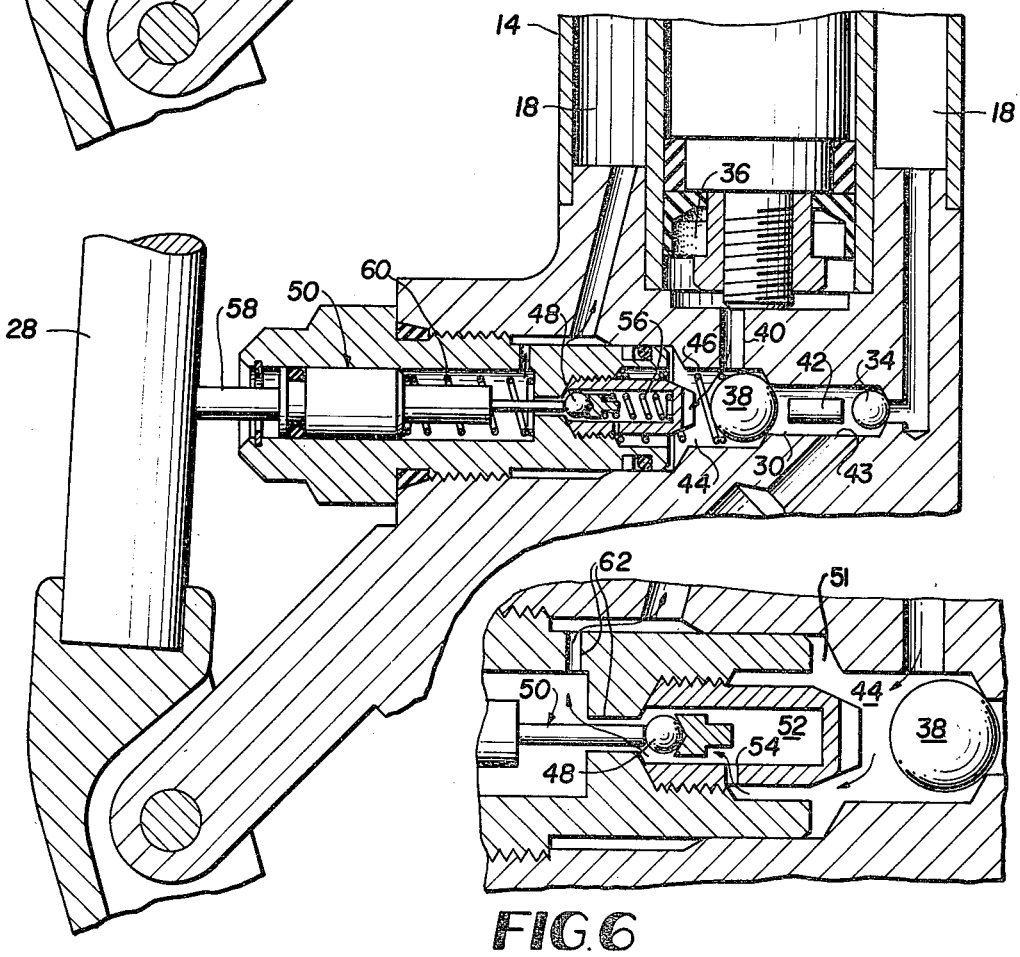
FIG. 6

PATIENT LIFTING DEVICE

BACKGROUND OF THE INVENTION

This invention relates to patient lifting devices. Such devices are in common use in hospitals, nursing homes, and in the homes of invalids, and they take on many different specific forms dictated by their specific function. Broadly speaking, however, such devices of the type to which the subject invention is applicable comprise an upright member of one type or another, a boom pivotably mounted on the upright member, a fluid cylinder pivotably mounted between the upright member and the boom, a fluid reservoir, and a manually operated pump used to force fluid from the reservoir into the chamber of the fluid cylinder in order to raise the boom. Of course, means must also be provided for transferring the fluid back to the reservoir from the chamber of the cylinder when it is desired to lower the boom. In the past, such means have required the person using the device either to release the pump handle or to use his other hand to actuate a separate toggle or button. Either option is, however, undesirable, for the person using the device is typically using his or her other hand to steady the patient being lifted by the device and his or her attention is too much on that patient for it to be convenient to release the handle and to reach for a separate toggle or button.

The problems suggested in the preceding paragraph are, of course, not intended to be exhaustive, but rather are among many which tend to reduce the effectiveness of prior patient lifting devices. Other noteworthy problems may also exist; however, those presented above should be sufficient to demonstrate that patient lifting devices appearing in the prior-art have not been altogether satisfactory.

OBJECTS OF THE INVENTION

It is, therefore, a general object of the invention to provide a patient lifting device which will obviate or minimize problems of the type previously described.

It is a particular object of the invention to provide a patient lifting device in which the person using the device does not have to either release the pump handle or use his other hand to actuate a separate toggle or switch in order to lower the boom.

It is a further object of the invention to provide a patient lifting device in which means actuated by the pump handle cause transfer of fluid from the fluid cylinder to the fluid reservoir, thereby permitting the boom to lower under the combined weight of the boom itself and anyone being carried by the boom.

Other objects and advantages of the present invention will become apparent from the following detailed description of a preferred embodiment thereof taken in conjunction with the accompanying drawings.

THE DRAWINGS

FIG. 4 is a side view in section and on an enlarged scale of the interface of the fluid cylinder, pump, and fluid reservoir shown in FIG. 2, showing the release mechanism in its non-actuated position.

FIG. 5 is a view similar to FIG. 4, but showing the release mechanism in its actuated position.

FIG. 6 is a fragmentary view on a greatly enlarged scale and in somewhat simplified form of a portion of the release mechanism in its actuated position.

DETAILED DESCRIPTION OF THE PRESENTLY PREFERRED EMBODIMENT

Figure 1:
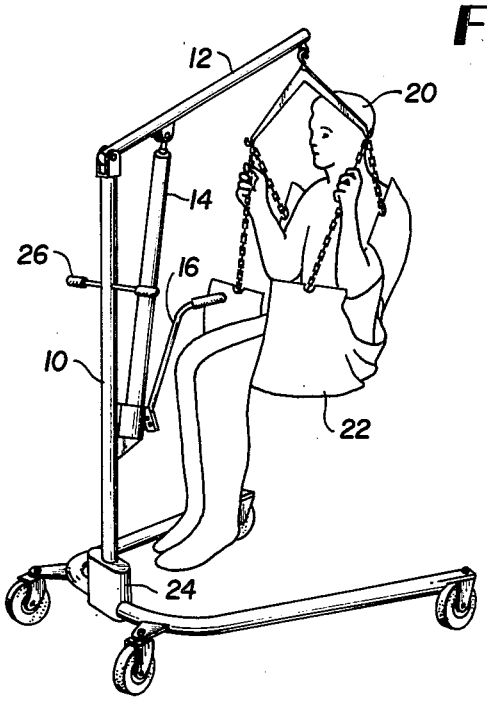
FIG. 1 is a perspective view of a patient lifting device incorporating the subject invention.
Figure 2:
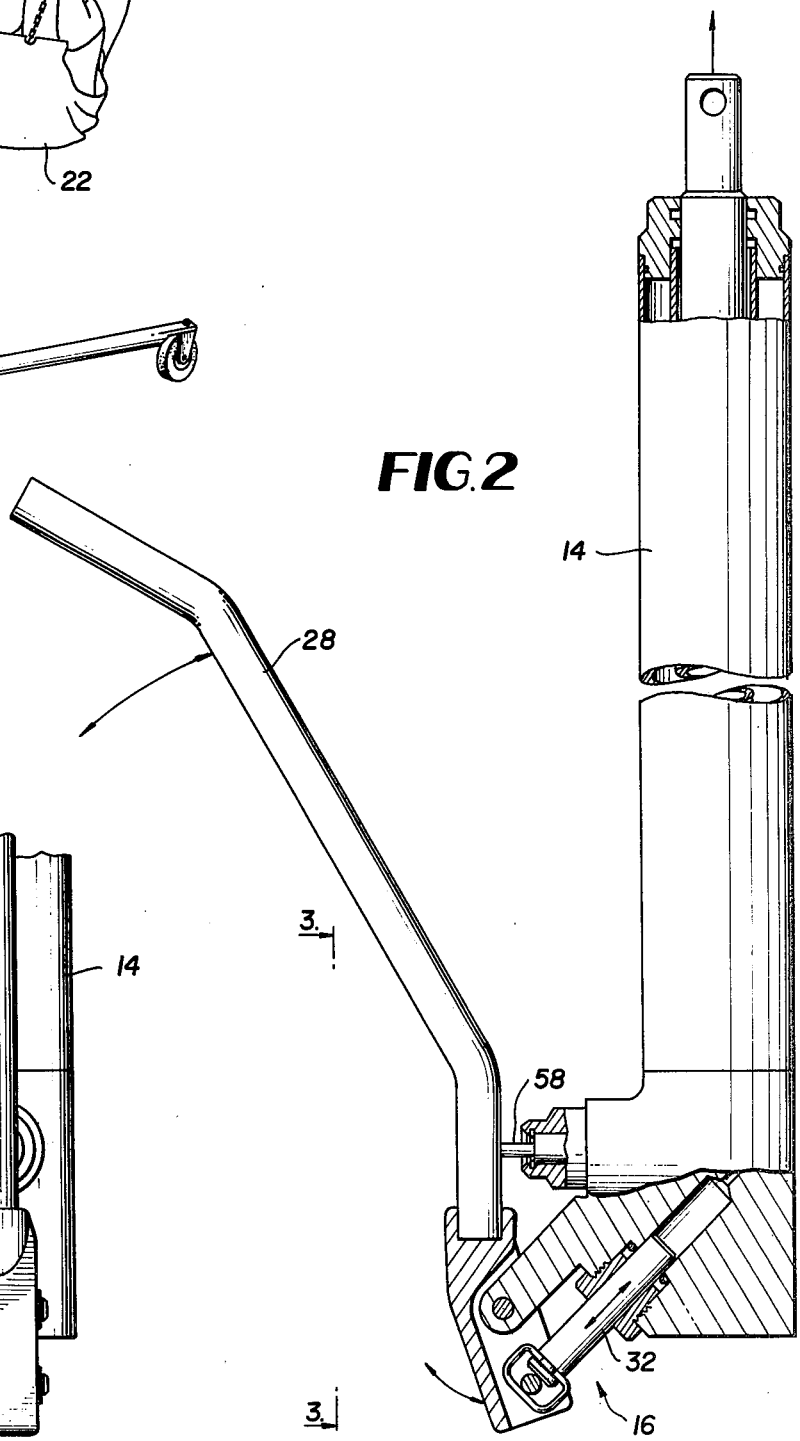
FIG. 2 is a side view, partly in section of a fluid cylinder, pump, and fluid reservoir incorporating the subject invention.
Figure 3:
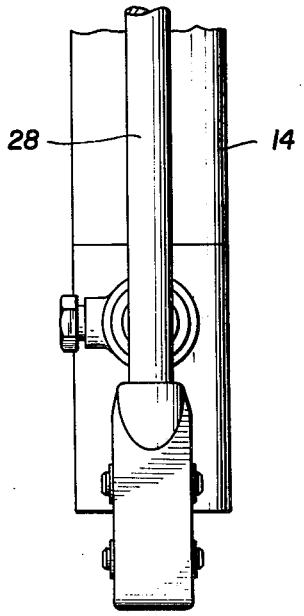
FIG. 3 is a view along the line 3—3 in FIG. 2.

Referring now particularly to FIG. 1, there will be seen a patient lifting device comprising an upright member 10, a boom 12 pivotably mounted on the upright member 10, a fluid cylinder 14 one end of which is connected to the upright member 10 and the other end of which is connected to the boom 12, and a manually operated pump 16 operatively associated with the fluid cylinder 14 such that operation of the pump 16 causes actuation of the cylinder. Although not shown in FIG. 1, the patient lifting device also comprises a reservoir 18 (shown in FIGS. 2, 4, and 5) for fluid to operate the cylinder 14. A patient 20 is shown seated in a conventional sling chair 22 suspended from the outer end of the boom 12. The cylinder 14 is pivotably mounted at at least one end (shown as the upper end in FIG. 1), and actuation of the fluid cylinder 14 raises the boom 12 and can be used to lift the patient 20. In addition, the upright member 10 can be journalled in the base 24 for at least limited rotation, permitting the patient to be swung in an arc about the upright member 10 by means of the handle 26.

The pump 16 may be better understood from FIGS. 2–5. As shown therein, the pump 16 comprises a handle 28, means defining a transfer chamber 30, and a pumping piston 32 activated by the handle 28 and operatively associated with the reservoir 18 and the transfer chamber 30 such that operation of the pumping piston 32 in one direction opens a valve 34 located at the inlet of the transfer chamber 30 and draws fluid from the reservoir 18 into the transfer chamber 30 and operation of the pumping piston 32 in the other direction closes the valve 34 and forces fluid from the transfer chamber 30 into the chamber 36 of the fluid cylinder 14. A valve 38 is located at the outlet to the transfer chamber 30, and the outlet is in communication via a conduit 40 with the chamber 36. A loose pin 42 is located in the transfer chamber 30 between the valves 34 and 38 to prevent the valve 34 from moving above the opening 43 of the pumping piston 32 into the transfer chamber 30. Instead of the illustrated pin 42, a weak compression spring could be used for this purpose.

The subject invention comprises means actuated by the handle 28 for transferring fluid from the chamber 36 to the reservoir 18. In particular, in the illustrated embodiment it comprises means defining a second transfer chamber 44 in fluid communication with the transfer chamber 30, the chamber 36, and the reservoir 18; a compression spring 46 which is located in the transfer chamber 44 so as to bear against the valve 38 and bias it towards its closed position; a valve 48 located at the outlet to the transfer chamber 44; and means 50 actuated by the handle 28 for opening the valve 48 when the handle is in position to cause transfer of fluid from the chamber 36 to the reservoir 18. As is apparent from the drawings, the combination of the spring 46 and the position of the pumping piston 32 when the handle 28 is in contact with the means 50 ensures that the valve 38 is closed when the handle 28 is in position to cause transfer of fluid from the chamber 36 to the reservoir 18.

As best seen in FIG. 6, the transfer chamber 44 is preferably divided into two parts, an outer chamber 51 and an inner chamber 52, by means mounted within the transfer chamber 44. At least one small hole 54 allows the restricted flow of fluid into the inner chamber 52, and the valve 48 is located at the outlet of the inner chamber 52. A compression spring 56 is located in the inner chamber 52 so as to bear against the valve 48 and bias it towards its closed position.

The means 50 comprises a plunger 58 which is biased outwardly by a compression spring 60 and which is forced inwardly to open the valve 48 by contact with the handle 28 when it is brought beyond its usual pumping position. A conduit 62 leads from the valve 48 to the reservoir 18, and it is sized at at least one point along its length to allow the restricted flow of fluid from the transfer chamber 44 to the reservoir 18 when the valve 48 is open. Preferably, and as best seen in FIG. 6, the plunger 58 passes through at least a portion of the conduit 62, thereby further reducing the effective cross-sectional area of the conduit.

It should be noted that, while the reservoir 18 has been shown as a separate chamber surrounding the fluid cylinder 14, it could equally well be placed elsewhere, or it could simply be the volume within the cylinder on the opposite side of the cylinder head from the chamber 36.

In use, pulling the handle 28 upwards by the normal amount causes the pumping piston to move downwardly, opening the valve 34 and drawing fluid (normally oil) from the reservoir 18 into the transfer chamber 30. During this stroke the valve 38 is closed. Pushing the handle 28 downwards then causes the pumping piston to move upwardly, closing the valve 34, opening the valve 38, and forcing fluid from the transfer chamber 30 into the transfer chamber 44. Since the valve 48 is closed all during this operation, the fluid flows from the transfer chamber 44, through the conduit 40, and into the chamber 36, where it causes the fluid cylinder 14 to extend. When it is desired to contract the fluid cylinder 14, the handle 28 is brought into contact with the plunger 58, opening the valve 48. At that point, the valve 34 is open, but the valve 38 is closed. The combined weight of the boom and anyone being carried by the boom then causes the fluid to flow from the chamber 36, through the conduit 40, into the outer chamber 51, through the hole 54, into the inner chamber 52, through the conduit 62, and into the reservoir 18. The fact the hole 54 and the conduit 62 are of restricted cross-sectional areas, however, insures that the lowering operation is gradual, so that no harm will come to the patient even if the plunger 58 is actuated accidentally by too-vigorous movement of the handle 28.

ADVANTAGES OF THE INVENTION

From the foregoing description of a patient lifting device in accordance with a preferred embodiment of the invention, those skilled in the art will recognize several advantages which singularly distinguish the subject invention from previously known devices. Some of those advantages are set forth below. However, while the following list of advantages is believed to be both accurate and representative, it does not purport to be exhaustive.

A particular advantage of the subject invention is that a person using the device does not have to either release the pump handle or use his other hand to actuate a separate toggle or switch in order to lower the boom.

A further advantage of the subject invention is that means actuated by the pump handle causes transfer of fluid from the fluid cylinder to the fluid reservoir, thereby permitting the boom to lower under the combined weight of the boom itself and anyone being carried by the boom.

Yet a further advantage of the subject invention is that means are provided to insure that the lowering operation is gradual, so that no harm will come to the patient even if the plunger is actuated accidentally.

CAVEAT

While the present invention has been illustrated by a detailed description of a preferred embodiment thereof, it will be obvious to those skilled in the art that various changes in form and detail can be made therein without departing from the true scope of the invention. Accordingly, the invention must be measured by the claims appended hereto and not by the fore-going preferred embodiment.

What is claimed is:

1. A patient lifting device comprising:

(a) an upright member;

(b) a boom pivotably mounted on said upright member;

(c) a fluid cylinder one end of which is connected to said upright member and the other end of which is connected to said boom, whereby activation of said fluid cylinder raises said boom and can be used to lift a patient;

(d) a reservoir for fluid to operate said fluid cylinder;

(e) a manually operated pump operatively associated with said fluid cylinder and said reservoir such that operation of said pump causes activation of said cylinder, said pump comprising:

(i) a handle;

(ii) first means defining a first transfer chamber, said first means including a first valve at the inlet to said first transfer chamber and a second valve at the outlet to said first transfer chamber;

(iii) a pumping piston actuated by said handle and operatively associated with said reservoir and said first transfer chamber such that operation of said pumping piston in one direction opens said first valve and draws fluid from said reservoir into said first transfer chamber and operation of said pumping piston in the other direction closes said first valve and forces fluid from said first transfer chamber into the chamber of said fluid cylinder; and (f) second means activated by said handle for transferring fluid from the chamber of said fluid cylinder to said reservoir, said second means comprising:

(i) third means defining a second transfer chamber, said third means including said second valve, which is located between said first and second transfer chambers, and a third valve at the outlet of said second transfer chamber;

(ii) fourth means for closing said second valve when said handle is in position to cause transfer of fluid from the chamber of said fluid cylinder to said reservoir; and (iii) fifth means actuated by sad handle for opening said third valve when said handle is in position to cause transfer of fluid from the chamber of said fluid cylinder to said reservoir.

2. A patient lifting device as recited in claim 1 wherein said third means comprises sixth means defining an inner chamber within said second transfer chamber, said sixth means containing at least one small hole allowing a restricted flow of fluid into said inner chamber and said third valve being located at the outlet of said inner chamber.

3. A patient lifting device as recited in claim 2 and further comprising means located in said inner chamber for biasing said third valve towards its closed position.

4. A patient lifting device as recited in claim 1 wherein said fifth means comprise an outwardly biased plunger which is forced inwardly to open said third valve by contact with said handle when said handle is in position to cause transfer of fluid from the chamber of said fluid cylinder to said reservoir.

5. A patient lifting device as recited in claim 4 and further comprising a conduit leading from said third valve to said reservoir, said conduit being sized at at least one point along its length to allow the restricted flow of fluid from said second transfer chamber to said reservoir when said third valve is open.

6. A patient lifting device as recited in claim 5 wherein said plunger passes through at least a portion of said conduit.

7. A patient lifting device as recited in claim 4 wherein said third means comprises sixth means defining an inner chamber within said second transfer chamber, said sixth means containing at least one small hole allowing the restricted flow of fluid into said inner chamber and said third valve being located at the outlet of said inner chamber.

8. A patient lifting device as recited in claim 7 and further comprising means located in said inner chamber for biasing said third valve towards its closed position.

9. A patient lifting device as recited in claim 1 and further comprising sixth means located in said first transfer chamber for biasing said first valve towards its closed position.

10. A patient lifting device as recited in claim 1 and further comprising sixth means located in said second transfer chamber for biasing said second valve towards its closed position.

11. A fluid motor comprising:

(a) a fluid cylinder;

(b) a reservoir for fluid to operate said fluid cylinder;

(c) a manually operated pump operatively associated with said fluid cylinder and said reservoir such that operation of said pump causes activation of said cylinder, said pump comprising:

(i) a handle;

(ii) first means defining a first transfer chamber, said first means including a first valve at the inlet to said first transfer chamber and a second valve at the outlet to said first transfer chamber;

(iii) a pumping piston activated by said handle and operatively associated with said reservoir and said first transfer chamber such that operation of said pumping piston in one direction opens said first valve and draws fluid from said reservoir into said first transfer chamber and operation of said pumping piston in the other direction closes said first valve and forces fluid from said first transfer chamber into the chamber of said fluid cylinder; and (d) second means activated by said handle for transferring fluid from the chamber of said fluid cylinder to said reservoir, said second means comprising:

(i) third means defining a second transfer chamber, said third means including said second valve, which is located between said first and second transfer chambers and a third valve at the outlet of said second transfer chamber;

(ii) fourth means for closing said second valve when said handle is in position to cause transfer of fluid from the chamber of said fluid cylinder to said reservoir; and (iii) fifth means actuated by said handle for opening said third valve when said handle is in position to cause transfer of fluid from the chamber of said fluid cylinder to said reservoir.

12. A fluid motor as recited in claim 11 wherein said third means comprises sixth means defining an inner chamber within said second transfer chamber, said sixth means containing at least one small hole allowing a restricted flow of fluid into said inner chamber and said third valve being located at the outlet of said inner chamber.

13. A fluid motor as recited in claim 12 and further comprising means located in said inner chamber for biasing said third valve towards its closed position.

14. A fluid motor as recited in claim 11 wherein said fifth means comprise an outwardly biased plunger which is forced inwardly to open said third valve by contact with said handle when said handle is in position to cause transfer of fluid from the chamber of said fluid cylinder to said reservoir.

15. A fluid motor as recited in claim 14 and further comprising a conduit leading from said third valve to said reservoir, said conduit being sized at at least one point along its length to allow the restricted flow of fluid from said second transfer chamber to said reservoir when said third valve is open.

16. A fluid motor as recited in claim 15 wherein said plunger passes through at least a portion of said conduit.

17. A fluid motor as recited in claim 14 wherein said third means comprises sixth means defining an inner chamber within said second transfer chamber, said sixth means containing at least one small hole allowing the restricted flow of fluid into said inner chamber and said third valve being located at the outlet of said inner chamber.

18. A fluid motor as recited in claim 17 and further comprising means located in said inner chamber for biasing said third valve toward its closed position.

19. A fluid motor as recited in claim 11 and further comprising sixth means located in said first transfer chamber for biasing said first valve towards its closed position.

20. A fluid motor as recited in claim 11 and further comprising sixth means located in said second transfer chamber for biasing said second valve towards its closed position.

21. A patient-lifting device comprising a boom pivotally mounted on an upright support and liftable by means of a hydraulic ram extending between the support and the boom, which ram can be supplied with hydraulic fluid from a reservoir by means of a pump operable manually by a pump handle, said device comprising valve means operable by more-than-normal motion of the pump handle in its non-working direction, which motion causes release of hydraulic fluid from the ram, allowing the boom to sink under its own weight.

22. A fluid motor comprising a hydraulic ram which can be supplied with hydraulic fluid from a reservoir by means of a pump operable manully by a pump handle, said motor comprising valve means operable by more-than-normal motion of the pump handle in its non-working direction, which motion causes release of hydraulic fluid from the ram.

* * * * *